US010657848B2

(12) United States Patent
Grossmann et al.

(10) Patent No.: US 10,657,848 B2
(45) Date of Patent: May 19, 2020

(54) METHOD FOR MARKING ELECTRICAL COMPONENTS

(71) Applicant: Phoenix Contact GmbH & Co. KG, Blomberg (DE)

(72) Inventors: Christian Grossmann, Detmold (DE); Bernd Naguschewski, Detmold (DE); Kilian Klages, Detmold (DE); Nicole Probach, Blomberg (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 16/067,632

(22) PCT Filed: Jan. 17, 2017

(86) PCT No.: PCT/EP2017/050838

§ 371 (c)(1),
(2) Date: Jul. 2, 2018

(87) PCT Pub. No.: WO2017/125364

PCT Pub. Date: Jul. 27, 2017

(65) Prior Publication Data

US 2019/0009573 A1 Jan. 10, 2019

(30) Foreign Application Priority Data

Jan. 18, 2016 (DE) ..... 10 2016 100 722
Apr. 22, 2016 (DE) ..... 10 2016 107 459

(51) Int. Cl.
*B41M 5/26* (2006.01)
*B41J 2/44* (2006.01)
(Continued)

(52) U.S. Cl.
CPC ..... *G09F 7/10* (2013.01); *B41J 2/442* (2013.01); *B41J 3/4073* (2013.01); *B41M 5/24* (2013.01);
(Continued)

(58) Field of Classification Search
CPC ..... H01L 23/544; G09F 3/02; G09F 3/205; G09F 2003/0201; B41J 3/4075; H01R 9/2683
See application file for complete search history.

(56) References Cited

U.S. PATENT DOCUMENTS 4,564,739 A 1/1986 Mattelin
5,993,267 A 11/1999 Lin
(Continued)

FOREIGN PATENT DOCUMENTS

DE 1857546 U 8/1962
DE 1956966 U 3/1967
(Continued)

OTHER PUBLICATIONS

U.S. Appl. No. 16,070,525, filed Jul. 17, 2018.
Helmut Hugel, et al., "Laser in der Fertigung", Technische Optik, Lasertechnologie, Dec. 2009, pp. 1-9.

*Primary Examiner* — John Zimmermann
(74) *Attorney, Agent, or Firm* — Leydig, Voit & Mayer, Ltd.

(57) ABSTRACT

A method for marking electrical components, in particular a plurality of series terminals situated one next to another, includes the following steps: attaching at least one unlabeled marking material at a predefined position to at least one component; introducing at least one component into a marking position in a marking device including a laser head; and labeling a marking material using the laser head.

10 Claims, 5 Drawing Sheets

(51) Int. Cl.

| | |
|---|---|
| ***B41J 3/407*** | (2006.01) |
| ***G09F 3/00*** | (2006.01) |
| ***G09F 7/00*** | (2006.01) |
| ***G09F 7/10*** | (2006.01) |
| ***B41M 5/24*** | (2006.01) |
| ***G09F 3/20*** | (2006.01) |

(52) U.S. Cl.
CPC ..... *B41M 5/26* (2013.01); *G09F 3/00* (2013.01); *G09F 3/205* (2013.01); *G09F 7/00* (2013.01)

(56) References Cited

U.S. PATENT DOCUMENTS

| | | | | |
|---|---|---|---|---|
| 2006/0051604 | A1 | 3/2006 | Koops et al. | |
| 2006/0283011 | A1* | 12/2006 | Muller | H05K 13/0015 29/834 |
| 2009/0104415 | A1 | 4/2009 | Schmajew | |
| 2010/0011979 | A1* | 1/2010 | Bier | B41J 3/28 101/407.1 |
| 2011/0104960 | A1 | 5/2011 | Feye-Hohmann | |
| 2011/0120981 | A1* | 5/2011 | Paganelli | B23K 26/0823 219/121.67 |
| 2011/0183542 | A1 | 7/2011 | Pizzi | |
| 2011/0253871 | A1* | 10/2011 | Bett | B65H 5/04 248/346.03 |
| 2011/0279841 | A1 | 11/2011 | Reibke | |
| 2013/0152440 | A1 | 6/2013 | Poelker | |
| 2013/0205566 | A1 | 8/2013 | Ruppert | |
| 2017/0011663 | A1 | 1/2017 | Hilmstedt et al. | |
| 2017/0282431 | A1 | 10/2017 | Speith et al. | |

FOREIGN PATENT DOCUMENTS

| | | | |
|---|---|---|---|
| DE | 6927061 | U | 12/1969 |
| DE | 3333386 | A1 | 4/1985 |
| DE | 10009750 | A1 | 9/2001 |
| DE | 20303475 | U1 | 5/2003 |
| DE | 10213110 | A1 | 10/2003 |
| DE | 1622223 | A1 | 2/2006 |
| DE | 102005053566 | A1 | 5/2007 |
| DE | 102006019118 | A1 | 10/2007 |
| DE | 202008010347 | U1 | 10/2008 |
| DE | 102008032837 | A1 | 1/2010 |
| DE | 102009017999 | A1 | 5/2010 |
| DE | 102009056713 | A1 | 6/2011 |
| DE | 102010022690 | A1 | 12/2011 |
| DE | 102010034993 | A1 | 2/2012 |
| DE | 102010047369 | A1 | 4/2012 |
| DE | 102013112789 | A1 | 5/2015 |
| DE | 102013113328 | A1 | 6/2015 |
| DE | 102013012389 | B4 | 10/2015 |
| DE | 102015109020 | A1 | 3/2016 |
| EP | S 5352442 | A | 5/1978 |
| EP | 2792499 | A1 | 10/2014 |
| EP | 2391999 | B1 | 3/2015 |
| JP | H 09220686 | A | 8/1997 |
| JP | 2005175371 | A | 6/2005 |
| SU | 967462 | A1 | 10/1982 |
| WO | WO 9747397 | A1 | 12/1997 |
| WO | WO 2010057768 | A1 | 5/2010 |

* cited by examiner

METHOD FOR MARKING ELECTRICAL COMPONENTS

CROSS-REFERENCE TO PRIOR APPLICATIONS

This application is a U.S. National Phase application under 35 U.S.C. § 371 of International Application No. PCT/EP2017/050838, filed on Jan. 17, 2017, and claims benefit to German Patent Application No. DE 10 2016 107 459.4, filed on Apr. 22, 2016, and German Patent Application No. DE 10 2016 100 722.6, filed on Jan. 18, 2016. The International Application was published in German on Jul. 27, 2017 as WO 2017/125364 under PCT Article 21(2).

FIELD

The present invention relates to a method for marking electrical components, in particular a plurality of series terminals situated one next to another. In addition, the present invention relates to a marking device for marking electrical components, in particular a plurality of series terminals situated one next to another.

BACKGROUND

For marking or identifying electrical components, in particular series terminals, different types of marking materials are used. The marking materials are, in particular, marking or identification plates, which are attached at predefined positions to the electrical components. For easy attachment of the marking or identification plates, groove-shaped plug-in recesses are usually formed in the housings of the electrical components or the series terminals, into which the marking plates can be inserted and plugged in. In addition, also marking materials are known, which are designed as adhesive labels or adhesive strips, so that the marking plates can be adhesively bonded onto the electrical components in the respective locations.

To create the marking materials, they are usually initially inserted as an unlabeled printing object, usually in card format, into a corresponding printer, for example an inkjet printer, a thermal transfer printer, a UV printer or a laser printer. The respectively required labeling of the marking material, which usually has a plurality of individual marking plates, is then typically carried out in the printers, so that the marking plates after printing first have to be separated into individual signs or strips. Subsequently, the installation of the individual marking plates on the individual components or series terminals, or on a terminal block made up from a plurality of series terminals situated one next to another, is carried out.

Since in particular series terminals are often installed in greater quantities on carrier rails, the installation of the individual identification plates is considerably time-consuming. For a manual installation, moreover, there is the risk that the identification plates are not correctly installed and plugged into the housing of the series terminals, so that the identification plates can retroactively detach. Moreover, there is the risk that the installer loses the individual identification plates during installation because of their relatively small dimensions.

In order to reduce the time required to install the identification plates or marking plates, automatic devices are known, with the aid of which individual identification plates can be picked-up and inserted into the corresponding plug-in recesses into the series terminals. Such a device for automatically installing identification plates is known from DE 10 2013 012 389 B4. The device, in particular, has a holding device for receiving an identification plate and a moveably mounted assembly stamp, with the aid of which an identification plate received by the holding device can be pressed into a groove-shaped plug-in recess at the series terminal.

Even though such a device for installing individual identification plates can reduce the time and effort for the installation, assigning the individual marking plates to the respective electrical components is associated with a relatively great effort. Additionally, the individual electrical components, in particular in the case of series terminals, are typically each provided with a plurality of identification plates, so that the correct assignment in this instance is also complex and prone to errors. In particular for symmetrically constructed series terminals, a faulty identification of individual connectors can result.

SUMMARY

In an embodiment, the present invention provides a method for marking electrical components, the method comprising: attaching at least one unlabeled marking material at a predefined position to at least one component; introducing the at least one component into a marking position in a marking device comprising a laser head; and labeling the at least one marking material using the laser head.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1A:
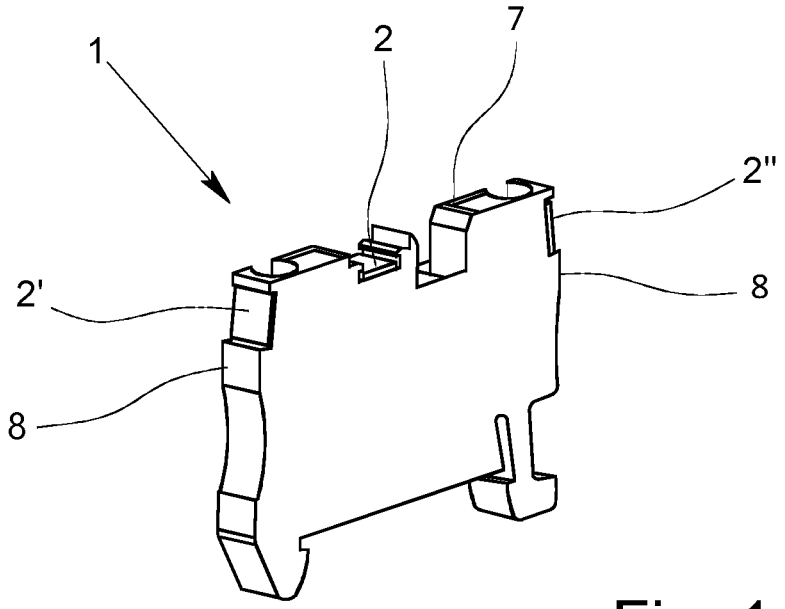
FIGS. 1*a*-1*d* show a schematic illustration of four consecutive steps of the method according to the present invention.
Figure 1B:
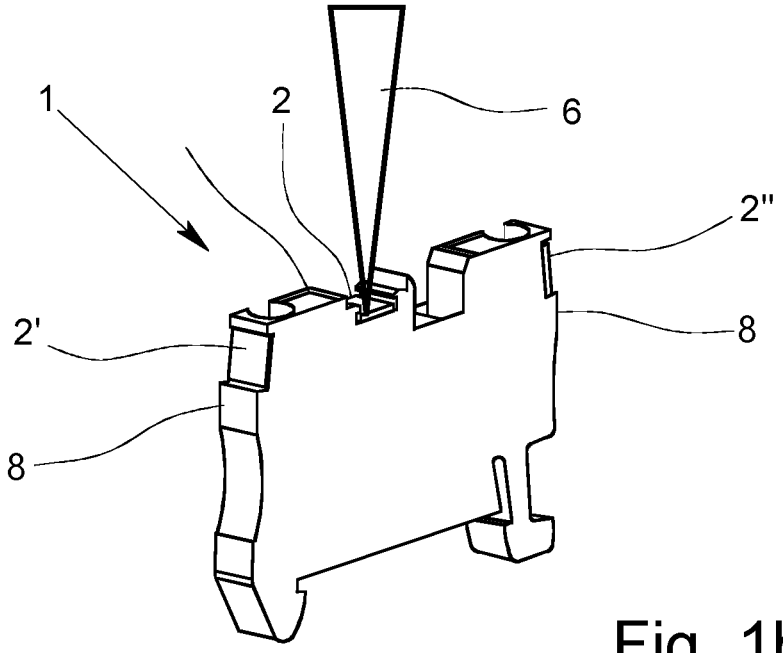
Figure 1C:
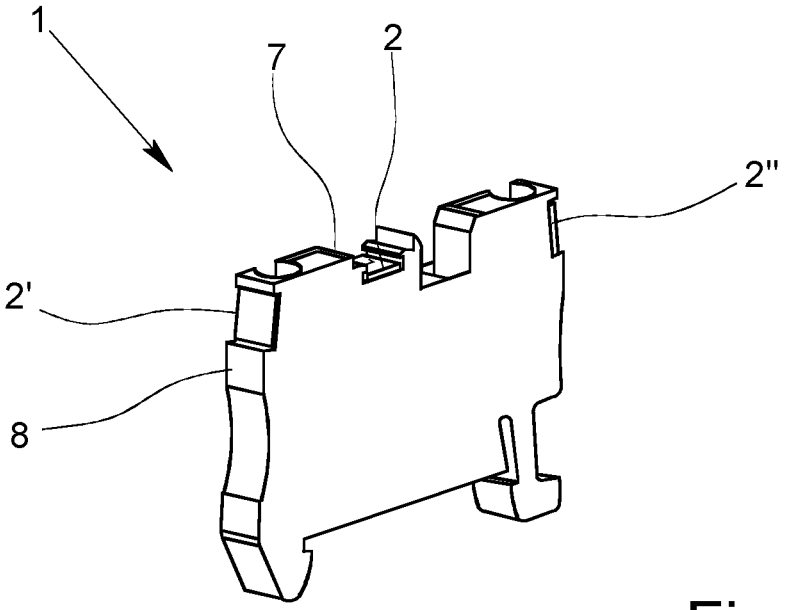

In an embodiment, the present invention provides a method characterized by the following steps:

- attaching at least one unlabeled marking material at a predefined position to at least one component;
- introducing at least one component into a marking position in a marking device, which has a laser head; and
- labeling at least one marking material with the aid of the laser head.

The method according to the present invention first differs from the methods extensively practiced in the prior art in that the marking material initially is not labeled before it is attached to the electrical component, but that the individual electrical components are first provided with unlabeled marking material. Only thereafter the labeling of the individual marking materials is carried out with the aid of the marking device having a laser head, for the purpose of which the electrical components are introduced into a marking position in the marking device. Thus, the advantage of the method according to the present invention is that the complex assignment of the individual, already labeled marking materials to the respective electrical components or correct position at the electrical components is omitted. In so doing, the time necessary to mark the components can be significantly reduced. Since typically not only individual electrical components but mostly greater quantities of components, in particular electrical series terminals, have to be marked, the time savings achievable by the method according to the present invention when assembling electrical components or series terminals are significant.

Even though the method according to the present invention in principle allows only to mark one electrical component having only one marking material or marking plate, the method in general is used to mark a plurality of electrical components, which respectively have a plurality of unlabeled marking materials. In this case, first the individual marking materials are attached, for example adhesively bonded, to the components to be marked, subsequently the components are moved into a marking position in the marking device, and then the marking materials of the electrical components are labeled. The sequence of labeling the marking materials, that is whether first all marking materials of an electrical component or first individual marking materials of electrical components situated one next to another are labeled, is selectable in this instance as a function of the positioning and configuration of the individual electrical components.

According to an advantageous embodiment of the method according to the present invention, for labeling the second marking material—or further marking materials—of a first electrical component and/or for labeling a marking material of a second electrical component—or further electrical component—the laser beam of the laser printer is correspondingly deflected. The labeling of individual marking materials, which are only at a relatively small distance to one another, therefore can be carried out by a corresponding deflection of the laser beam of the laser head without having to change the position of the electrical component or the electrical components in the marking device.

Alternatively or also additionally, it also may be provided according to the method according to the present invention that the position of an electrical component in the marking device is changed before labeling the second—or a further—marking material of the electrical component and/or the position of the electrical components in the marking device before labeling a marking material of a second—or further—electrical component. For this purpose, such a position change of the electrical components within the marking device occurs in particular always then when the distance of the individual marking materials to be labeled is of such magnitude that a labeling of the marking materials according to specifications cannot be ensured simply by a corresponding deflection of the laser beam of the laser head.

Furthermore, a change in the position of an electrical component in the marking device is also provided when for electrical components marking materials are situated at surfaces of the component which are at an angle to one another. In particular for electrical series terminals, marking plates are frequently situated at the top side of the housing as well as also at the end faces of the housing, which typically have an angle of more than 45° in relation to the top. In this case, the electrical series terminals are, after labeling the marking materials of one surface, for example the top side, respectively pivoted within the marking device so that then a labeling of the marking material of another surface, for example an end face, is made possible according to specifications.

For the marking device according to the present invention for marking electrical components, in particular of a plurality of series terminals situated one next to another, the object previously mentioned is achieved by the features of patent Claim 6.

The marking device according to the present invention has a laser head for a linear pivot system, the laser head serving to label marking material attached to the electrical components to be marked. The linear pivot system has a receiving device for receiving the electrical components, a pivot device for pivoting the receiving device and a linear feed for linearly moving the electrical components received by the receiving device. The linear pivot system of the marking device serves the purpose to receive the electrical components to be marked and to move them into the respective marking position relative to the laser head. In this instance, the pivot device, in addition to the linear movement of the electrical components, enables a rotational movement of the receiving device and, for this reason, also of the electrical components held by the receiving device, as a result of which a labeling of marking materials at different surfaces of the electrical components is possible.

According to an advantageous embodiment of the method according to the present invention, the pivot device has two rotary mounts lying opposite each other, between which the receiving device is situated. In this instance, the receiving device by its ends is connected to the rotary mounts so that when the rotary mounts are pivoted, a corresponding pivoting of the receiving device and therefore also of the electrical components situated in the receiving device results. The two rotary mounts generate a virtual rotary axis, which coincides with the longitudinal axis of the electrical components situated in the receiving device.

Preferably, the receiving device is configured in such a manner that it can accommodate a carrier rail, on which the electrical components to be marked, in particular a plurality of series terminals plugged one next to another into the carrier rail, are attached. As a result, the series terminals to be marked can be situated relative to each other and on the carrier rail, such as the series terminals after marking—together with the carrier rail—are to be situated, for example, in an electric switch cabinet.

Prior to the carrier rail, including the series terminals attached thereto, being attached on the receiving device and being introduced into the marking device, according to the method according to the present invention, the unlabeled marking plates are attached at the predefined positions of the individual series terminals or of the terminal block. For this purpose, the marking plates can, for example, be adhesively bonded or plugged into grooves provided for the series terminals, and the attachment of the marking plates can be carried out manually or also automatically with the aid of a corresponding installation device. After the carrier rail, having the series terminals attached thereto, has been moved with the aid of the linear feed into the first marking position in the marking device, the labeling of the marking plates can be carried out with the aid of the laser head. Depending onto which surface of the series terminal the marking plates are attached, first a pivoting of the receiving device, and therefore also of the series terminals, relative to the laser head occurs so that the marking plates to be labeled by their top side are directed toward the laser head. Subsequently, the further marking plates of the individual series terminals are labeled one after the other, and depending on the position of the marking plates, the position of the series terminals optionally is first changed with the aid of the linear pivot system.

According to one embodiment of the marking device according to the present invention, the marking device has a sensor for detecting an identification marking of the electrical components to be marked. Moreover, an evaluation and control unit is provided, in which the identification marking of the electrical components to be marked, which is detected by the sensor, is evaluated, and the laser head is controlled on the basis of the detected identification marking. As a result, an automatic detection of the electrical components introduced into the marking device is possible, on the basis of which then the labeling of the individual marking materials attached to the components is carried out.

Alternatively or additionally to the automatic detection of the identification marking with the aid of a sensor, in particular an optical sensor, the respective identification marking of the electrical components to be marked can also be entered manually or via a corresponding control program into the evaluation and control unit. For this purpose, the marking device can have a corresponding display and keyboard, by which the identification markings of the electrical components to be marked can be entered. Instead of a display and a separate keyboard, the marking device can also have a touch screen, which takes over the function of display and keyboard.

On the basis of the four illustrations of FIG. 1, the method according to the present invention for marking electrical components is first to be described, a series terminal 1 being shown as an electrical component in FIG. 1. FIG. 1*a* shows a series terminal 1, in which, in a first step, three marking plates 2, 2', 2" are adhesively bonded as marking material in corresponding grooves into series terminal 1, three marking plates 2, 2', 2" all being unlabeled. In a second step, series terminal 1 prepared in such a manner is introduced into a marking position in a marking device 3 illustrated in FIG. 2. According to FIG. 2, marking device 2 in this instance has at least one laser head 4 for labeling marking plates 2, 2', 2" and a linear and pivot system 5. In the next method step, the labeling of first marking plate 2 of series terminal 1 by laser head 4 is carried out, which in FIG. 1*b* is illustrated by schematically shown laser beam 6. Subsequently—as it is shown in FIG. 1*c*—first marking plate 2 of series terminal 1 is labeled in that, for example, the number "1" is applied onto marking plate 2.

Figure 1D:
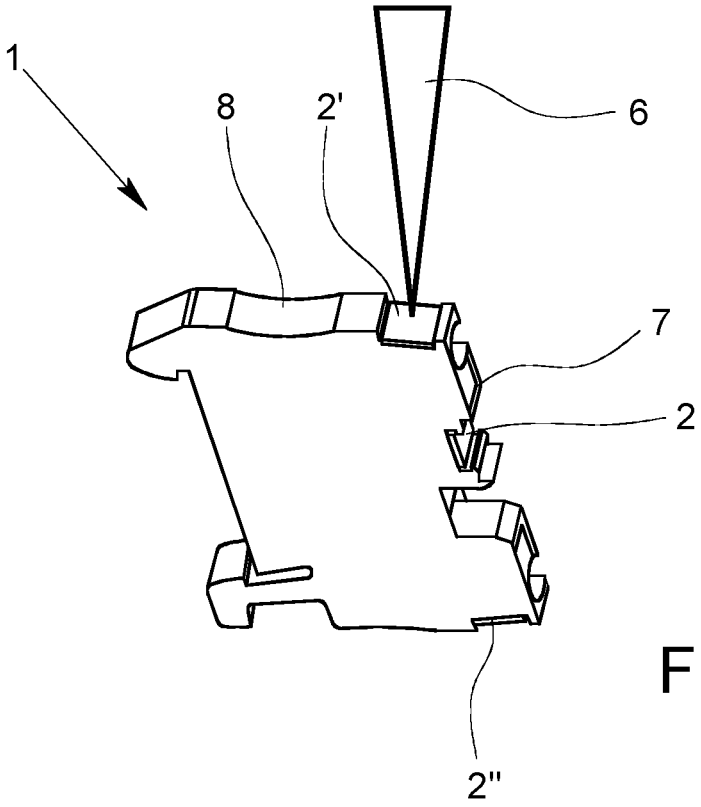

For labeling second marking plate 2' of series terminal 1, which unlike the first marking plate is not situated at top side 7 but at an end face 8 of series terminal 1, in a next step first series terminal 1 is rotated by approximately 90° in the clockwise direction. In so doing, second marking plate 2' by its top side is directed towards laser head 4 so that then second marking plate 2' can be labeled, such as it is shown in FIG. 1*d* again by schematically illustrated laser beam 6. In order to finally also label third marking plate 2", series terminal 1 is rotated by 180° in the counter-clockwise direction, so that then second marking plate 2" by its top side is directed towards laser head 4.

Figure 2:
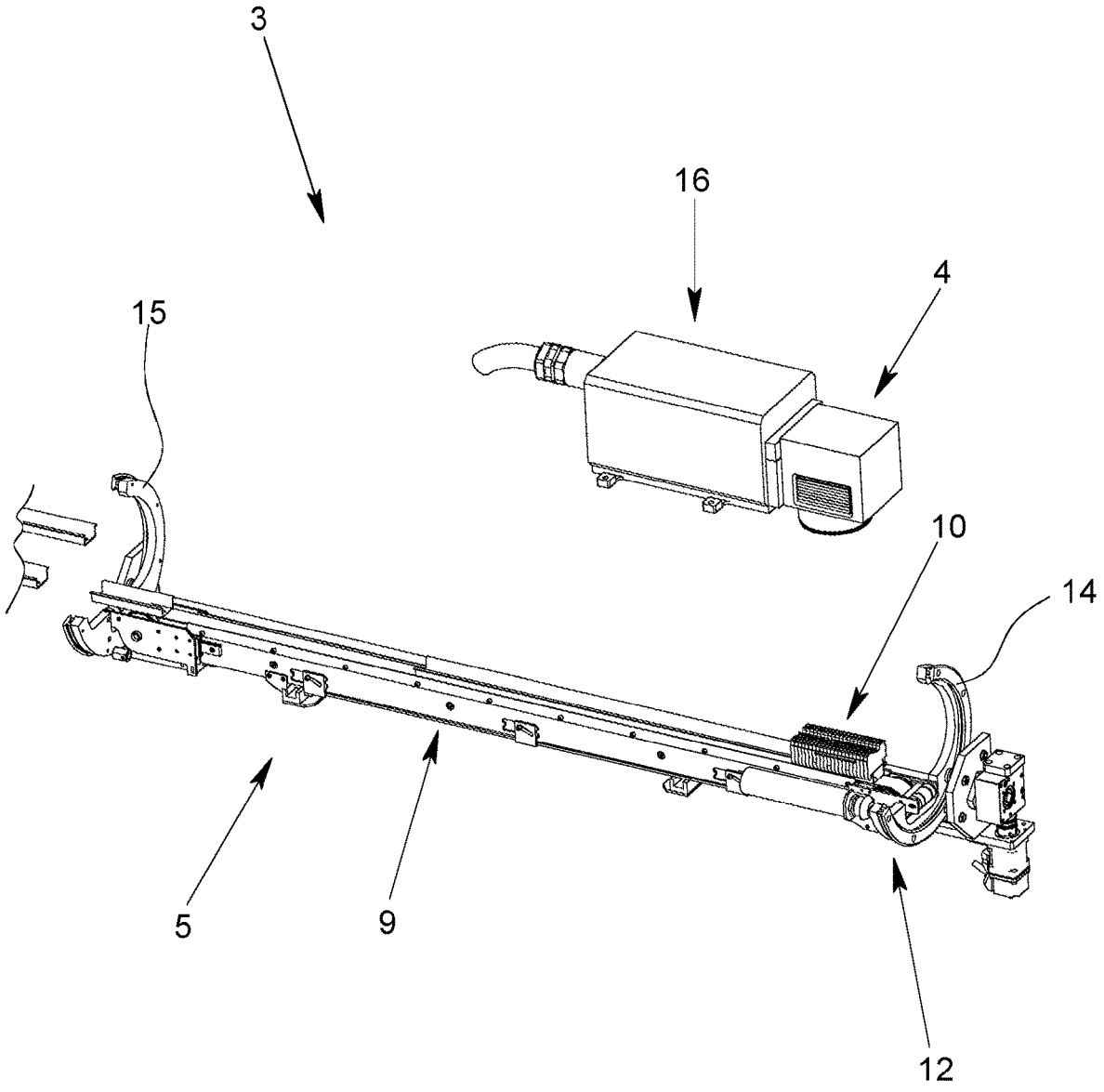
FIG. 2 shows a simplified view of the marking device according to the present invention.

FIG. 2 shows a simplified view of marking device 3 according to the present invention, here only laser head 4 and linear pivot system 5 being shown. Not shown, for example, is a housing completely accommodating marking device 3, which also holds laser head 4 within the illustrated predefined position above linear pivot system 5. Linear pivot system 5 has a receiving device 9 for receiving series terminals 1, in the exemplary embodiment according to FIG. 2, a plurality of series terminals 1 being situated one next to another, which form a terminal block 10, and being plugged into a carrier rail 11. Receiving device 9 correspondingly is suited to receive carrier rail 11, for the purpose of which the rail is designed in an approximately U-shaped manner viewed in a cross-section.

Moreover, linear pivot system 5 additionally has a pivot device 12 for pivoting receiving device 9 and a linear feed 13, which can linearly move series terminals 1 or carrier rail 11 having terminal block 10 along receiving device 9. In the illustrated exemplary embodiment, pivot device 12 has two rotary mounts 14, 15 lying opposite each other, between which receiving device 9 is situated, the ends of receiving device 9 fixedly connected to respectively one rotary mount 14, 15. Thus, a pivoting of rotary mounts 14, 15 results in a corresponding pivoting of receiving device 9 and of series terminals 1 situated on receiving device 9.

Figure 3:
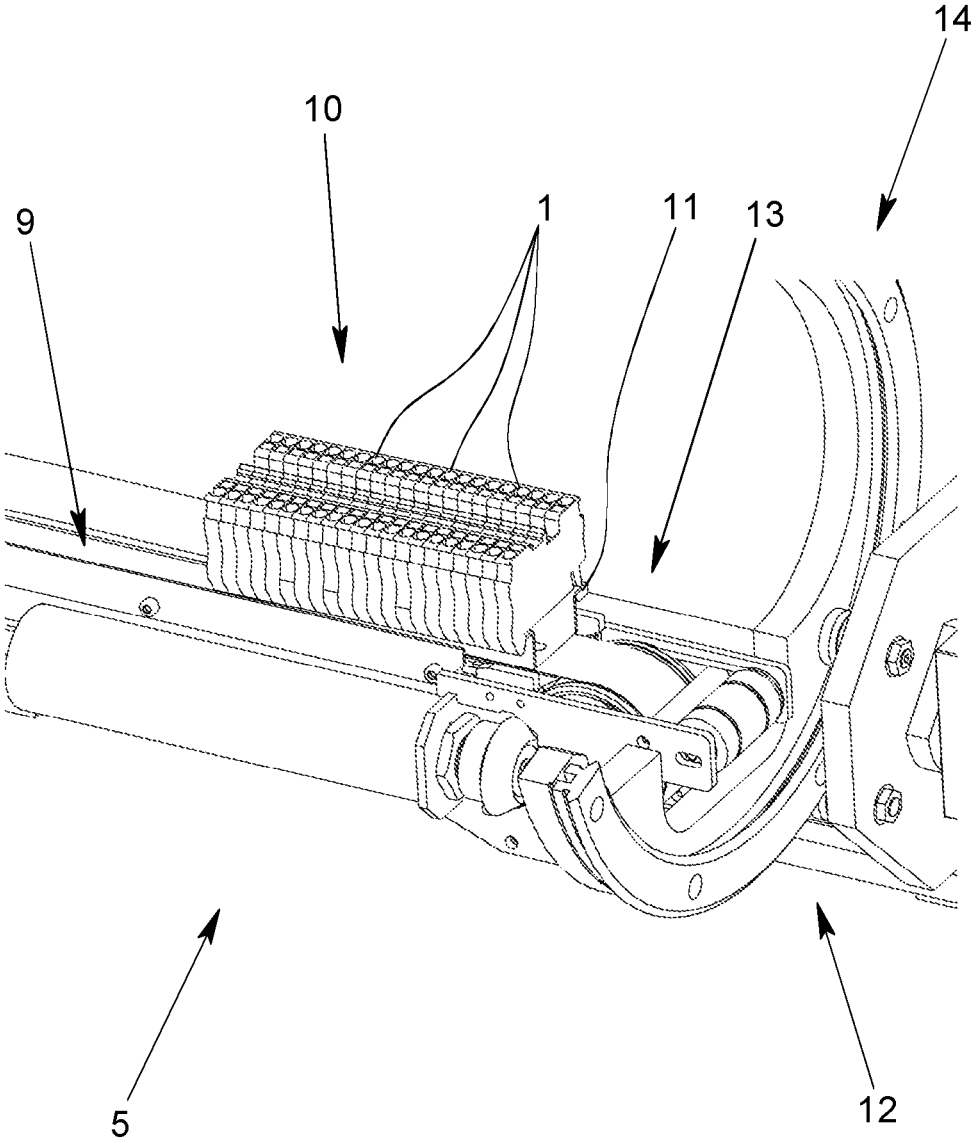
FIG. 3 shows an enlarged view of a section of the marking device according to FIG. 2.
Figure 4:
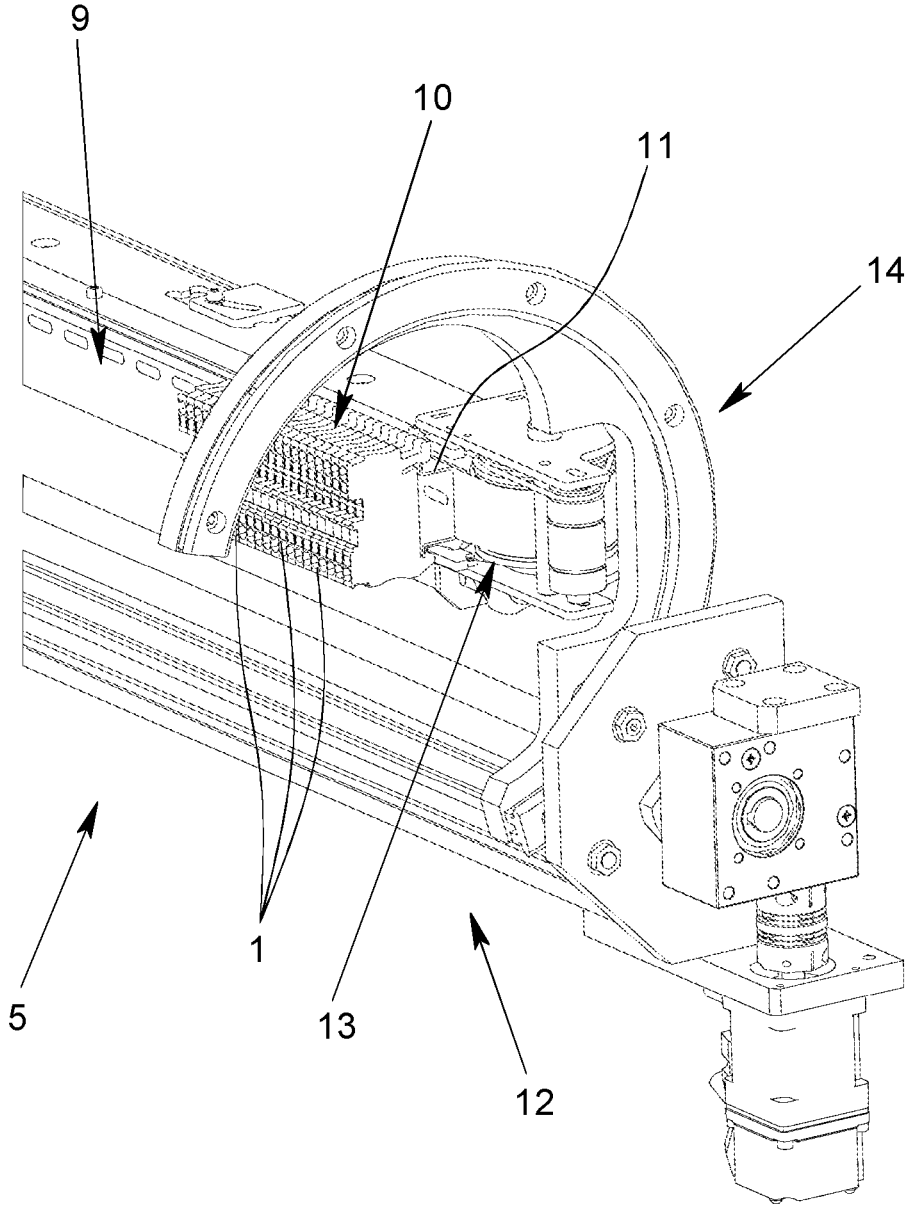
FIG. 4 shows an enlarged view of a section of the marking device according to FIG. 2 including a linear pivot system pivoted by 90°.

As can be seen from the enlarged illustrations according to FIGS. 3 and 4, the virtual rotary axis of pivot device 12 extends through terminal block 10, the virtual rotary axis of pivot device 12 either coinciding with the center axis of terminal block 10 or at least extending in the vicinity of the center axis of terminal block 10. In so doing, it results that the distance of series terminals 1 to laser head 4 does not change or only marginally changes if series terminals 1 are pivoted with the aid of pivot device 12. In this way, it is possible that marking plates 2 attached to the top side of series terminals 1 as well as also marking plates 2', 2" attached at end faces 8 of series terminals 1 can be labeled with the aid of laser head 4 without that the position of laser head 4 has to be changed within marking device 3. Laser head 4 can thus be situated in a stationary manner within marking device 3, which simplifies the connection and the operation of laser head 4. In order to label marking plates 2" with the aid of laser head 4, which are attached at an end face 8 of series terminals 1, pivot device 12 is pivoted from the position shown in FIG. 3 by approximately 90° into the position shown in FIG. 4. As a result, no longer marking plates 2 attached at top side 7 of series terminals 1 but marking plates 2" attached to end face 8 of series terminals 1 are then directed towards laser head 4.

Moreover, marking device 3 additionally has an evaluation and control unit 16 assigned to laser head 4, which on the basis of the respective identification marking of series terminals 1 to be marked or terminal block 10 controls laser head 4. The identification marking of series terminals 1 to be marked or of terminal blocks 10, for example, can be entered with the aid of a keyboard and a display into evaluation and control unit 16. Moreover, the identification marking of series terminals 1 to be marked can also be imported into evaluation and control unit 16 with the aid of a corresponding control program. Finally, there is also the possibility that marking device 3 has a sensor for automatically detecting the identification marking of series terminals 1 to be marked or of terminal block 10 to be marked. As a result, an automatic detection of series terminals 1 introduced into marking device 3 is possible, on the basis of which then the labeling of individual marking plates 2, 2', 2" attached to the series terminals can be carried out.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of"or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A method for marking electrical components, the method comprising:

attaching at least one unlabeled marking material at a predefined position to at least one component;

introducing the at least one component into a marking position in a marking device comprising a laser head and a linear pivot system, the at least one component being received via the linear pivot system and being put into the marking position relative to the laser head, the linear pivot system comprising:

a receiving device configured to receive the at least one electrical component, a pivot device configured to pivot the receiving device, and a linear feed configured to linearly move the at least one electrical component received by the receiving device; and labeling the at least one marking material using the laser head, wherein the pivot device comprises two rotary mounts lying opposite each other, and wherein the receiving device is situated between the rotary mounts and ends of the receiving device are connected to the rotary mounts.

2. The method as recited in claim 1, wherein the at least one component includes at least one electrical component;

wherein at least two unlabeled marking materials are attached to the at least one electrical component, and wherein first and second marking materials are labeled.

3. The method as recited in claim 1, wherein the at least one component includes at least two electrical components situated one next to another respectively; wherein the at least one unlabeled marking material is attached to the at least two electrical components; and wherein the at least one marking material of the second electrical component is labeled.

4. The method as recited in claim 2, wherein, for labeling the second marking material of a first electrical component and/or for labeling a marking material of a second electrical component, a laser beam of the laser head is deflected.

5. The method as recited in claim 2, wherein a position of an electrical component in the marking device is changed prior to labeling the second marking material of the electrical component and/or a position of the electrical components in the marking device is changed prior to labeling a marking material of a second electrical component.

6. A marking device for marking electrical components, comprising:

a laser head configured to label marking material attached to the electrical components; and a linear pivot system, comprising:

a receiving device configured to receive the electrical components, a pivot device configured to pivot the receiving device, and a linear feed configured to linearly move the electrical components received by the receiving device, wherein the pivot device comprises two rotary mounts lying opposite each other, and wherein the receiving device is situated between the rotary mounts and ends of the receiving device are connected to the rotary mounts.

7. The marking device as recited in claim 6, wherein the receiving device is configured to receive a carrier rail on which a plurality of series terminals forming a terminal block are attached.

8. The marking device as recited in claim 6, further comprising:

a sensor configured to detect an identification marking of the electrical components to be marked; and an evaluation and control unit, wherein the evaluation and control unit is configured to evaluate the identification marking of the electrical components to be marked, which has been detected by the sensor, and to control the laser head on the basis of the detected identification marking.

9. The method as recited in claim 1, wherein the electrical components are a plurality of series terminals situated one next to another.

10. The marking device as recited in claim 6, wherein the electrical components are a plurality of series terminals situated one next to another.

* * * * *